US006722068B2

(12) United States Patent
Ohlsson

(10) Patent No.: US 6,722,068 B2
(45) Date of Patent: Apr. 20, 2004

(54) SYSTEM FOR BILL-POSTING

(75) Inventor: Jan Ohlsson, Jarfalla (SE)

(73) Assignee: SCA Packaging Sweden AB (SE)

( * ) Notice: Subject to any disclaimer, the term of this patent is extended or adjusted under 35 U.S.C. 154(b) by 0 days.

(21) Appl. No.: 10/000,905

(22) Filed: Nov. 15, 2001

(65) Prior Publication Data

US 2002/0086785 A1 Jul. 4, 2002

Related U.S. Application Data

(62) Division of application No. 09/408,344, filed on Sep. 29, 1999, now Pat. No. 6,560,847, which is a continuation of application No. PCT/SE98/00545, filed on Mar. 26, 1998.

(30) Foreign Application Priority Data

Apr. 7, 1997 (SE) ..... 9701269

(51) Int. Cl.[7] ..... G09F 15/00

(52) U.S. Cl. ..... 40/610; 40/611.06; 40/611.01; 40/649

(58) Field of Search ..... 40/610, 649–654.01, 40/611

(56) References Cited

U.S. PATENT DOCUMENTS

| | | | | | |
|---|---|---|---|---|---|
| 2,373,778 | A | * | 4/1945 | Quinby | 40/610 |
| 3,310,901 | A | | 3/1967 | Sarkisian | 40/793 |
| 3,827,169 | A | | 8/1974 | Chase et al. | 40/624 |
| 3,877,572 | A | * | 4/1975 | Wiener, Jr. | 206/223 |
| 4,145,828 | A | | 3/1979 | Hillstrom | 40/793 |
| 4,185,408 | A | | 1/1980 | Tracy | 40/564 |
| 4,362,591 | A | | 12/1982 | Tracy | 156/300 |
| 4,498,255 | A | | 2/1985 | Heard | 40/793 |
| 4,512,094 | A | | 4/1985 | Seely | 40/793 |
| 4,512,095 | A | | 4/1985 | Seely | 40/793 |
| 4,523,400 | A | | 6/1985 | Seely | 40/793 |
| 4,729,183 | A | | 3/1988 | Tarter et al. | |
| 4,751,115 | A | | 6/1988 | Smith et al. | 428/12 |
| 4,756,107 | A | | 7/1988 | Hillstrom | 40/603 |
| 4,794,712 | A | | 1/1989 | Wood | |
| 4,823,489 | A | | 4/1989 | Cea | |
| 4,937,959 | A | | 7/1990 | Palmer et al. | 40/647 |
| 4,958,458 | A | | 9/1990 | Hillstrom | 40/793 |
| 5,046,543 | A | | 9/1991 | Levy | 160/84.1 |
| 5,234,231 | A | | 8/1993 | Hollander et al. | 281/2 |
| 5,265,362 | A | | 11/1993 | Yamaguchi | 40/603 |
| 5,307,575 | A | | 5/1994 | Ivansson et al. | 40/793 |
| 5,470,301 | A | * | 11/1995 | Brunt, II | 40/539 |
| 5,471,775 | A | | 12/1995 | Hoyt et al. | 40/601 |
| 5,598,650 | A | * | 2/1997 | Brown | 40/594 |
| 5,613,614 | A | | 3/1997 | Richardson | |
| 5,732,496 | A | | 3/1998 | Tanaka | 40/784 |
| 5,815,971 | A | | 10/1998 | Rothe et al. | 40/718 |
| 5,926,986 | A | | 7/1999 | Dingle | 40/792 |
| 5,930,928 | A | | 8/1999 | Kantola et al. | 40/793 |

FOREIGN PATENT DOCUMENTS

| | | |
|---|---|---|
| DE | 195 06 049 | 11/1995 |
| FR | 2218042 | 8/1974 |
| GB | 2291672 | 1/1996 |
| SE | 7511636-8 | 1/1978 |
| WO | 92/16928 | 10/1992 |

* cited by examiner

*Primary Examiner*—Cassandra H. Davis
(74) *Attorney, Agent, or Firm*—Altera Law Group, LLC

(57) ABSTRACT

A method and system of placarding wherein at least one sheet of corrugated cardboard is provided with printed matter on at least one side. The sheet is also provided with at least one score crossing the sheet. The sheet is foldable into an easily transportable unit. At a placarding site, the sheet is unfolded and inserted into a holder. The holder retains the sheet such that at least one part of an edge area of the sheet is enclosed by the holder.

5 Claims, 5 Drawing Sheets

SYSTEM FOR BILL-POSTING

This Appln is a Div. of Ser. No. 09/408,344 filed Sep. 29, 1999 in U.S. Pat. No. 6,560,847 which is a con't of PCT/SE98/00545 filed Mar. 26, 1998.

BACKGROUND OF THE INVENTION

1. Field of the Invention

The present invention relates to a method of placarding and a system of placarding adapted to the method.

2. Description of the Related Art

Putting up advertising placards by pasting thin sheets of printed paper on to a surface intended for placarding is known. Standard methods of putting up large placards generally involve pasting a plurality of smaller sheets of paper which are made to carry a part of an advertising message, onto the placarding surface, so as to match up the design. This is a time-consuming method that requires great skill on the part of those pasting up the placards. Applying large advertising placards in this way also often results in unsuitable working positions, which may give rise to industrial injuries and mean that those carrying out the placarding have to do this from a ladder or the like. The relatively large amount of time spent also means that those pasting up the placards alongside a traffic route or a railway track are exposed to a further element of risk during this time. With renewed placarding on the same placarding surface, the placard layers accumulate one on top of another, which means that the placarding surface gradually comes to carry a considerable weight and therefore, in order not to overload the surface, the placarding surface has to be cleaned by tearing off the layers of placard. The accumulation of placard layers can also result in uneven and hence aesthetically unappealing surfaces, which can also make it more difficult to match up designs. It is also in the nature of the method that replacarding is rendered more difficult or impossible in very cold or damp weather. It is not possible at present to recycle the placard sheets owing to the adhesive generally used and the difficulty of removing the placards from the placarding surface.

According to one embodiment of the present invention, a method of placarding is produced which has the advantages specified below and overcomes the disadvantages of the known method described above.

The invention also produces a system of placarding intended for the method according to the present invention which has the advantages specified below and overcomes the disadvantages of the known system of placarding described above.

Preferred embodiments of the method and the system of placarding intended for this also have any or some of the characteristics specified in respective subordinate claims.

The method according to the invention and the products produced by the said method have several advantages:

Using the method and the system according to the invention, replacarding can be done rapidly by means of simple operations and performed by unskilled personnel.

By using the method and the system of placarding according to the invention, stands for display surfaces do not need to be designed to support the accumulated weight of a plurality of placard layers.

The method and the system according to the invention allow replacarding to be carried out regardless of temperature and damp weather conditions.

The method and the system according to the invention also allow the placarding material to be re-used and, where this is collected, complete recycling thereof, thereby achieving great environmental advantages.

The method and system of placarding according to the invention also allow the placarding surface to be used for a permanent advertising message, when placarding is not continuous.

Furthermore, the method and the system according to the invention allow the placard sheets to be arranged so as to support or to simulate three-dimensional surfaces.

The majority of placarding surfaces intended for placarding in the known manner can easily be adapted for placarding by the method and the system according to the invention.

The invention will be explained in more detail below with the aid of an example of an embodiment of the method of placarding according to the present invention and the system of placarding intended for this, and with reference to the drawings attached in which.

Figure 1:
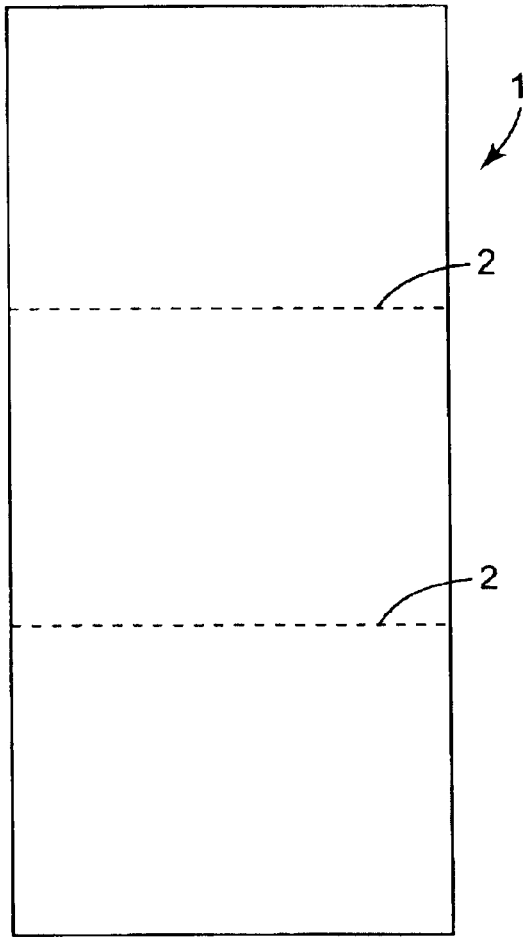
FIG. 1 shows a sheet according to a first embodiment of the present invention.
Figure 3B:
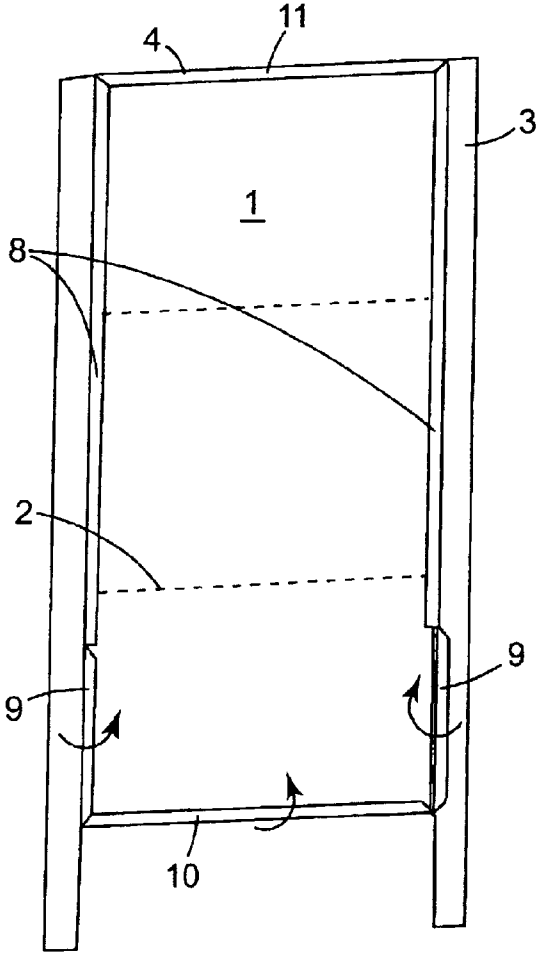
Figure 3A:
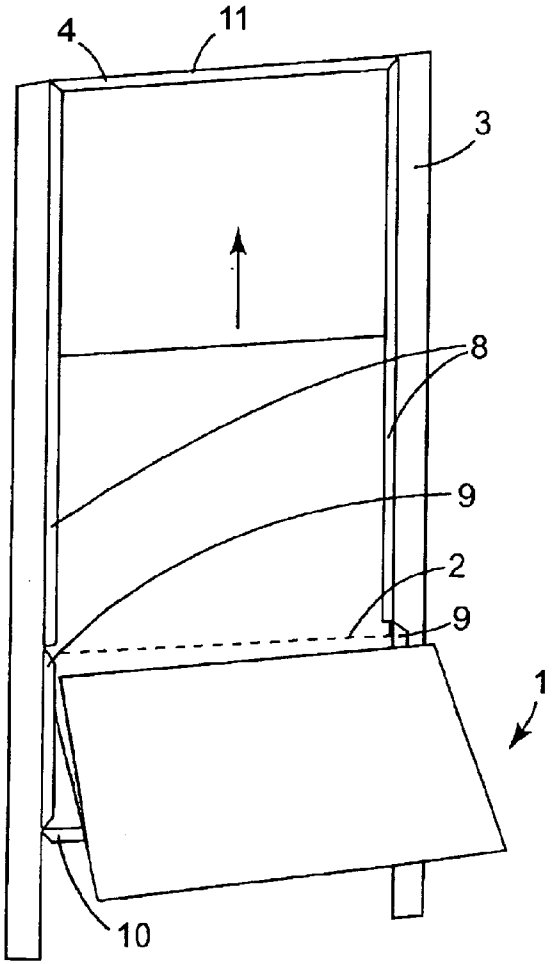

FIG. 3*a* illustrates application of the sheet according to FIG. 1 in a holder specially intended therefor.

FIG. 3*b* shows how the sheet according to FIG. 3*a* can be fastened to the holder.

Figure 4:
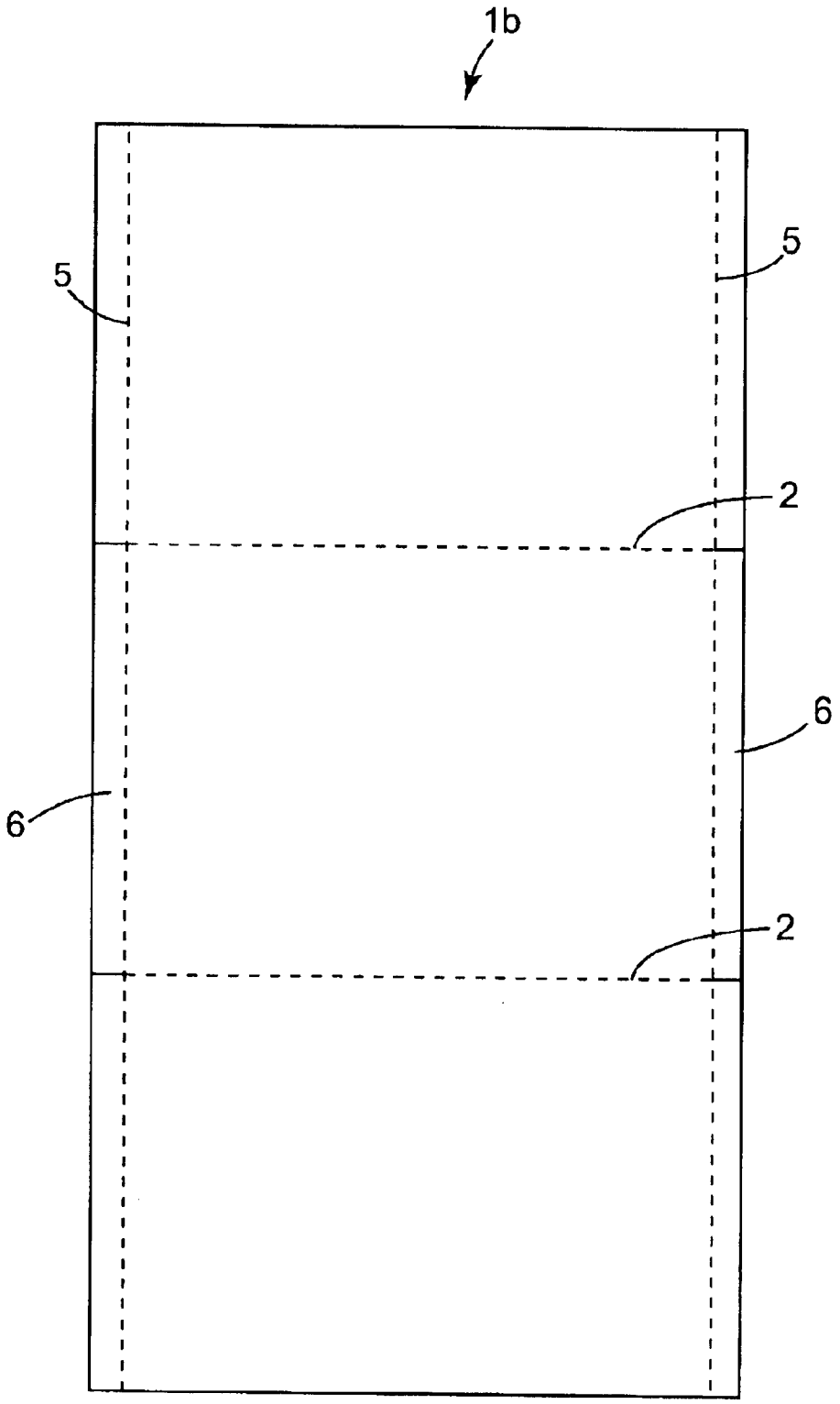
Figure 5A:
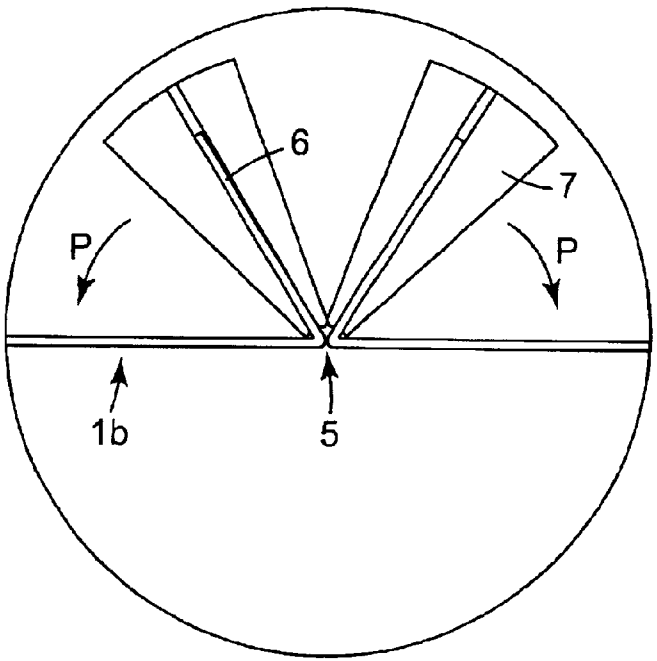
Figure 5:
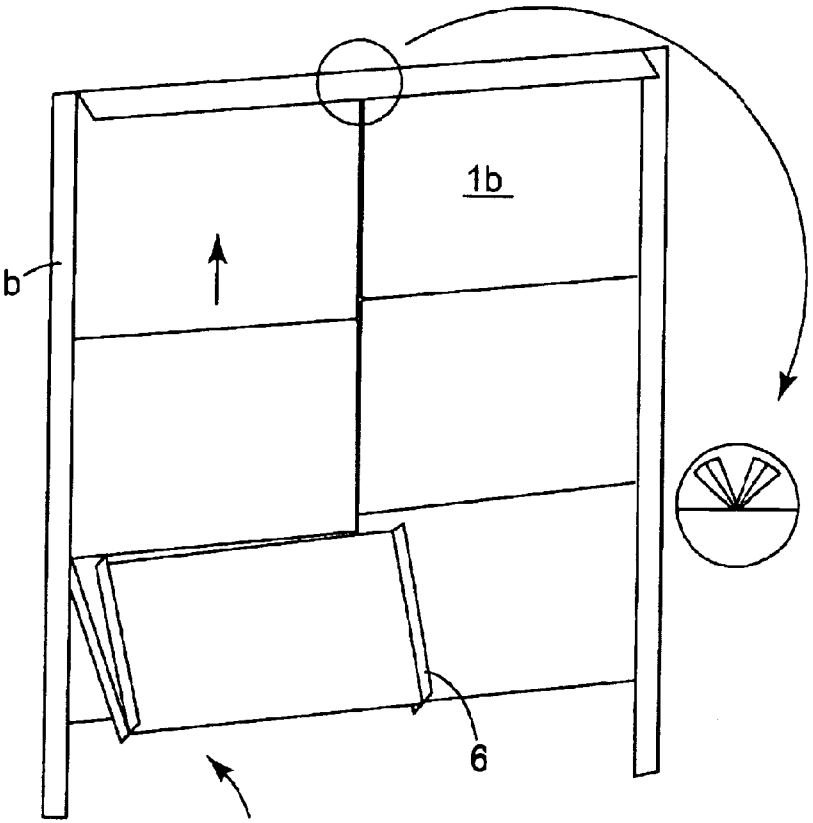

FIG. 4 shows a sheet according to a second embodiment of the present invention FIG. 5 illustrates the application of matching the design of two sheets provided with printed sections according to FIG. 4 in a special holder intended therefor.

FIG. 5*a* shows a partial enlargement of the fastening circled in FIG. 5

Figure 6:
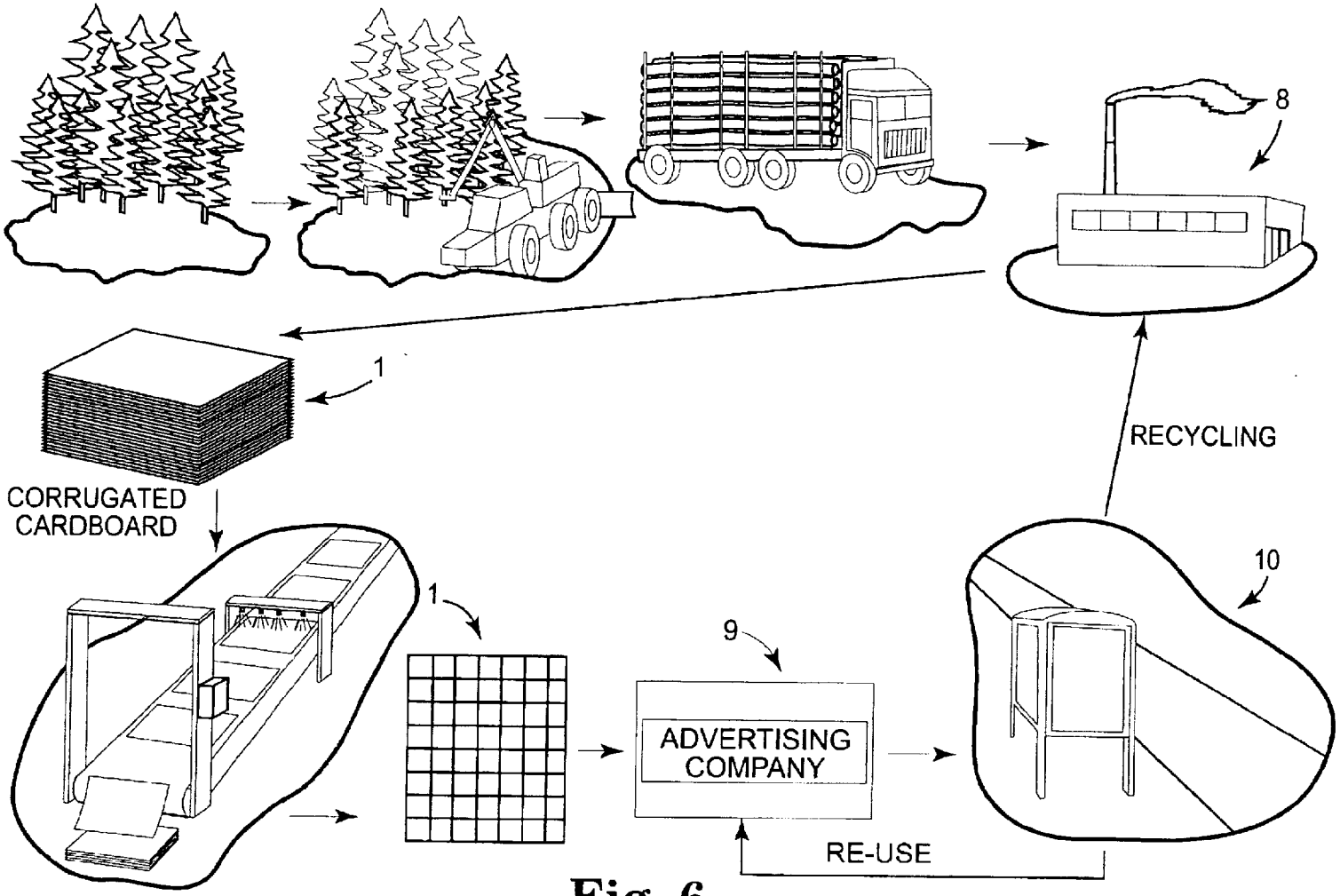

FIG. 6 illustrates, in diagrammatic form, how the method and the system according to the present invention permit re-use and recycling of the placard sheets.

The sheet 1 according to a first embodiment of the present invention shown in FIG. 1 is suitably made of corrugated cardboard or some similar material. The sheet 1 is intended to be provided with printed advertising matter on at least one side. The surface of the sheet 1 is preferably provided with a layer acting as moisture barrier. This layer preferably allows the sheet to be recycled without first having to remove the layer. The sheet 1 furthermore has two scores/grooves 2 extending across it, about which it is adapted to be folded up into an easily transportable unit. The scores/grooves 2 are preferably formed parallel to the sheet flute tubes. The sheet 1 may, for example, be of the usual size for placarding of 3000×1400 mm or some other arbitrary size.

Figure 2:
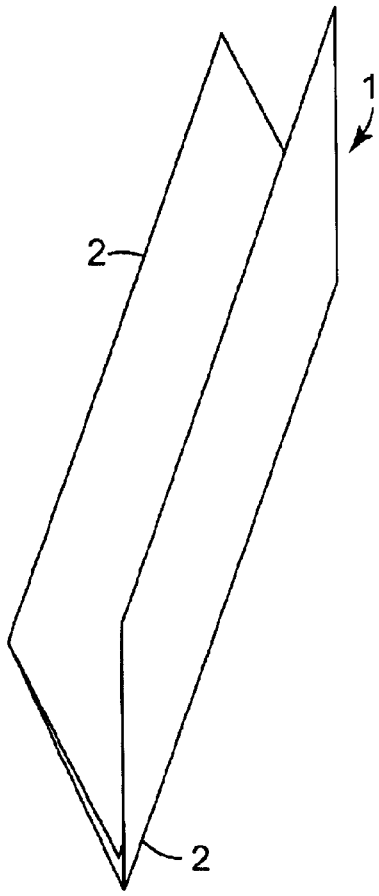
FIG. 2 illustrates the method of folding up the sheet according to FIG. 1 into an easily transportable unit.

FIG. 2 shows how the sheet according to FIG. 1, can be folded up about its scores/grooves 2 crossing the sheet into an easily transportable unit, for transport to an advertising company depot or a placarding site. Because the sheet 1 can be folded up in this way, even large sheets can be easily transported in a standard vehicle.

It will be seen from FIG. 3*a* how the sheet 1, according to FIG. 1, after transport to a placarding site in the folded state, according to FIG. 2, can be unfolded and applied in a holder 3 specially intended for holding the sheet. The holder 3, as shown in the figure, for example, can be designed with a frame 4 corresponding to the periphery of the sheet, the frame being provided with longitudinal slots which are adapted to receive and enclose the edges of the sheet. In use, the frame 4 is opened at one end and the sheet is then pushed into the slots, following which the frame 4 is closed around the free edge of the sheet as illustrated in FIG. 3*b*. Pushing the sheet 1 into slots in the frame 4 of the holder also prevents water getting into the tube flutes and adversely affecting the characteristics of the sheet. The sheet 1 is preferably applied so that its tube flutes are oriented horizontally.

FIG. 4 shows a sheet 1*b* of corrugated cardboard according to a second embodiment of the present invention. The said sheet 1*b* is preferably intended to be used together with one or more similar sheets, each carrying a printed section. In order to permit application with matching of the design between the printed sections, the sheet 1*b*, in addition to the characteristic features as specified in the description of the first embodiment according to FIG. 1, is also provided with at least two essentially parallel scores/grooves 5, each defining two elongated opposing edge areas of the sheet 6. The printed section of each sheet 1*b* is formed between the elongated edge areas 6 on at least one side of the sheet 1*b*.

As will be seen from FIG. 5, two sheets 1*b* provided with printed sections are adapted to form a complete placarding image in that the elongated edge areas 6 are folded so that they form angles with the printed surface of the sheet. The sheets 1*b* are then applied so that a score/groove 5 defining an elongated edge area on each sheet is fixed parallel side by side thereby matching the design between the printed sections in a holder 3*b* specially intended for the sheets. The holder 3*b* is adapted to retain the sheets 1*b* in that at least part of their elongated edge areas 6 is enclosed by the rim of the holder 3*b*. The sheets 1*b*, as shown, for example, in the detached circle in FIG. 5, are fixed behind the placarding surface at their respective elongated folded-in edge areas 6, and this affords them protection against moisture, whilst fixing them behind the placarding surface means that the sheets 1*b* can be applied in such a way that the printed sections can essentially adjoin one another.

FIG. 5*a* shows, by means of a partial enlargement of the content of the detached circle in FIG. 5, how the sheets 1*b* can be fixed behind the placarding surface so that a score/groove 5 defining an elongated edge area 6 on each sheet 1*b* can be fixed parallel so as to match the design between the sections. To achieve this the elongated edge areas of the sheets are folded to form angles with the printed surfaces of the sheets and are then inserted into the fastening devices 7 located in the position shown in FIG. 5*a*. The fastening devices are then twisted in the direction as indicated by the arrows P and locked, which results in the sheets 1*b* being put under tension and thus fixed by the holder 3*b*.

FIG. 6 shows in diagrammatic form how the method and the system according to the present invention permit re-using and recycling of the placard sheets 1, 1*b*. The sheets 1, 1*b* are manufactured conventionally from raw timber material which is cut and transported to a manufacturing plant 8, and recycled material. Following this the sheets are provided with advertising printed matter, a layer acting as moisture barrier and the scores/grooves 2, 5 that are required in order to allow the sheet 1, 1*b* to be folded up into an easily transportable unit. The folded sheet 1, 1*b* is then transported to an advertising company depot 9, from where it is transported to the placarding site 10 when it is time for the advertising campaign. At the placarding site the sheet is unfolded and applied in a holder 3 specially intended for the sheets. After its use at the placarding site 10 the sheet can be released from the holder 3, 3*b* and thereafter folded up again into the easily transportable unit and transported back to the advertising company depot 9. There it can then be stored before once again being transported to the same site or to a new placarding site 10, where the sheet 1, 1*b* is again unfolded to its full size and applied in a holder 3, 3*b* specially intended for this, for a repeat advertising campaign. On conclusion of placarding, the sheet 1, 1*b* is removed from the holder 3, 3*b*, folded up and transported to a recycling plant 9 for recycling. It is also possible to re-use the sheet 1, 1*b* by providing it with printed matter on both sides and, after its use at the placarding site 10 at which one of its sides was displayed, the sheet can be released from the holder 3, 3*b*, turned and placed back in the holder again so that its other side is now displayed.

It will be obvious to a person skilled in the art that the method of the invention is not confined to the embodiments described above, but can rather lend itself to modifications within the scope of the idea of the invention defined in the claims below. Thus, for example, the sheet may be made of any material with similar characteristics, and the person skilled in the art will moreover realise that the holders for the sheets may be made in many different ways. Furthermore the sheets, because of their relative rigidity, can also easily be adapted to carry further formed elements provided with printed sections, the said forms, for example, possibly resembling elements in the advertising message to be communicated. Alternatively the sheet itself may be adapted to permit application in the holder so that it assumes a form other than the entirely plane form.

What is claimed is:

1. A system of placarding, comprising:

at least one sheet provided with printed matter on at least one side, the sheet having at least two essentially parallel scores crossing the sheet, the sheet being adapted to be folded up into an easily transportable unit and unfolded at a placarding site;

a holder at the placarding site adapted for holding the sheet unfolded to full size, the holder being adapted to receive and to retail the unfolded sheet therein by enclosing at least one part of an edge area of the sheet;

wherein the scores define two elongated opposing edge areas of the sheet, and each sheet on at least one side is provided between the elongaged edge areas with at least one printed section, the at least one printed section is adapted to form a complete placarding image including at least two sheets unfolded to full size, the elongated edge areas are folded to form angles with a printed surface of the sheet and are adapted so that a score defining an elongagted edge area on each sheet is fixed parallel and side by side matching a design between printed sections in the holder, the holder is adapted to retain the sheets along at least one part of the elongated edge areas enclosing the sheet therein.

2. The system of placarding according to claim 1, wherein the sheet is provided on at least one side with printed matter and a layer acting as a moisture barrier, and the holder is also adapted to prevent moisture from getting into the sheet from edges thereof by enclosing at least a portion of the edges of the sheet.

3. The system of placarding according to claim 1, wherein the printed matter on at least one side of the sheet further comprises printed matter on both sides of the sheet.

4. The system of placarding according to claim 1, wherein the sheet is provided with one or more printed sections, the printed sections being adapted to simulate a three-dimensional surface when the sheet is retained in the holder.

5. The system of placarding according to claim 1, wherein the sheet is adapted to permit application in the holder such that at least a portion of the sheet resides in a plane different from a plane of a printed section of the sheet.

* * * * *